United States Patent [19]

Paulson

[11] 4,299,693

[45] Nov. 10, 1981

[54] SEPARATOR

[75] Inventor: Jerome I. Paulson, Spring, Tex.

[73] Assignee: Allied Industries, Houston, Tex.

[21] Appl. No.: 145,378

[22] Filed: Apr. 30, 1980

[51] Int. Cl.[3] ..... B07B 7/04

[52] U.S. Cl. ..... 209/3; 209/138; 209/140

[58] Field of Search ..... 209/3, 5, 8, 138, 139 R, 209/140, 141, 39, 40, 474–476, 212, 215; 55/100–102, 360; 222/630; 406/138, 175; 361/215, 212, 222; 15/1.5 R

[56] References Cited

U.S. PATENT DOCUMENTS

| | | | |
|---|---|---|---|
| 2,568,068 | 9/1951 | Harpman | 361/222 |
| 3,312,342 | 4/1967 | Brown | 209/3 |
| 3,991,479 | 11/1976 | Dionne | 361/212 X |
| 3,997,433 | 12/1976 | Liu et al. | 209/144 X |
| 4,159,941 | 7/1979 | Avery | 209/3 |

*Primary Examiner*—Ralph J. Hill

[57] ABSTRACT

Disclosed is an apparatus and method for separating a pellet-like product from fines mixed therewith. The apparatus includes a housing having a fines outlet and a product outlet disposed at a lower portion of the housing. An inlet conduit extends into the housing and terminates in a nozzle. The inlet conduit receives quantities of the product and fines entrained in a propellant fluid such as pressurized air. An imperforate baffle having an impact surface is disposed within the housing so that the impact surface faces the nozzle to intercept the product issuing from the nozzle. Apparatus is provided for generating an electric charge neutralizing magnetic field to envelop the entrained product and fines before the product impinges upon the impact surface of the baffle.

7 Claims, 2 Drawing Figures

SEPARATOR

BACKGROUND OF THE INVENTION

The present invention relates to apparatus for the separation of a product from much smaller particles mixed therewith and more particularly to such apparatus in which the product and smaller particles are transported in a fluid stream. Such devices are often called "elutriators" in the trade.

The removal of fines (e.g., dust) and streamers from a pellet like product is often necessary in many industries. One such industry is plastics manufacturing in which pellets are employed as the raw material in the molding of plastic articles. The presence of fines and streamers mixed with the pellets hampers plastics processing in several ways. First of all, the presence of fines and streamers in the finished product is undesirable from a product standpoint. Second, the presence of fines and streamers in the molding machines themselves often results in production delays and inefficiencies because of machine down time required for cleaning between production runs.

Because of the long-standing nature of the problem of fines mixed with product, there have been numerous attempts to improve separation capability. Proposed systems for dealing with the problem include washing and settling apparatus and vertical air-assisted separators. One of the most effective separators known to date is disclosed by Avery in U.S. Pat. No. 4,159,941 the disclosure of which is incorporated herein by reference. This separator which is adapted for separating plastic pellets or granules from fines and streamers subjects the fluid borne material to three separating stages. In the first stage, the product and fines mixed therewith, travelling at a relatively high vertical velocity, are directed against an imperforate barrier or baffle. This baffle absorbs all of the linear momentum of the product pellets allowing them to drop under the influence of gravity to a product outlet. The fines, however, entrained in the air flow and having a much higher surface area to mass ratio than the product pellets, do not drop after impact but continue to be conveyed in the air stream. Not only does the impact of the product with the baffle allow the product to fall toward the outlet, but the inertial stresses which develop when the product is suddenly stopped by the baffle aid in dislodging any fines which have become stuck to the pellet. In the second stage of cleaning with the Avery apparatus, a reverse flowing stream of wash air enhances separation, and a third stage employing a chimney draft effect virtually eliminates the possibility of pellets being conveyed along with the fines out of the separator.

Although the separator disclosed by Avery is able consistently to remove a large proportion of the fines from the pellet product, e.g., 75 percent or more, the remaining fines still penalize the quality of the finished product. It is, therefore, an object of this invention to provide apparatus and method capable of separating a significantly higher fraction of fines and streamers from the product pellets than before economically and technically feasible.

A further object is such apparatus which is of relatively simple design, inexpensive to manufacture and maintain, and operable at relatively high flow rates.

Yet a further object of this invention is apparatus which can be rather simply retrofitted to existing separating equipment.

Still further objects and advantages of the invention disclosed herein will be in part specifically pointed out and will be in part apparent in what follows.

SUMMARY OF THE INVENTION

It has been discovered that static electricity induced bonds between the pellet product and fines constitute a major factor limiting the separation efficiency of known elutriators. Although there is a tendency for the fines to separate from the pellets because of the inertial stresses developed as the pellets are decelerated upon impact with the barrier in a conventional impact separator, the electrostatic bonds are often greater than the inertial separating forces because of the very low masses of typical fines and streamers.

Accordingly, the apparatus and method of this invention include means for neutralizing substantially all of the static electrical charges residing on the fines and product pellets. In particular, the separation apparatus disclosed herein includes a housing having a fines outlet and a product outlet disposed at a lower portion of the housing. An inlet conduit is provided which extends into the housing and supplies the product and fines entrained in a moving propellant fluid. This inlet conduit terminates in a nozzle. An imperforate baffle is disposed within the housing and has an impact surface spaced away from and facing the nozzle. The baffle is located to intercept substantially all of the product issuing from the nozzle and is sized to allow the propellant fluid to flow past the baffle to the fines outlet. Apparatus is provided for generating an electric charge neutralizing magnetic field which envelops the product and fines entrained in the propellant fluid at a location before the product pellets impinge upon the baffle. In this way, electrostatic charges which cause the fines to adhere to the pellets are neutralized so that when the pellets are decelerated upon impact with the barrier, the fines are dislodged therefrom and are conveyed by the propellant fluid to the fines outlet.

In a preferred embodiment of the invention, the separator includes a substantially symmetrical housing having a vertical axis of symmetry. A fines outlet is provided at the top of the housing, and a product outlet is provided at the lower portion of the separator. The housing includes an intermediate cylindrical portion. In this embodiment, the inlet conduit terminates in an upwardly facing nozzle located at a position intermediate the fines outlet and the product outlet. A baffle is provided having an axis of symmetry coincident with the vertical axis of symmetry of the housing. This baffle includes a substantially concave, imperforate lower surface spaced apart from and facing the nozzle to allow vertical entry of the product and fines entrained in the propellant fluid and located to intercept substantially all of the product issuing from the nozzle. The baffle further includes upwardly tapering lateral sides to define with the cylindrical portion of the housing an annular flow conduit for the propellant fluid having a cross section which increases in area in the upward direction. It is preferred that the means for neutralizing static electric charges include a coil of electrically conducting material disposed around the periphery of the inlet conduit. Alternatively, the charge neutralizing coil may be disposed around the outside of the cylindrical portion of the housing at a location below the lower impact surface of the baffle so that electrostatic charges on the fines and product pellets are neutralized before the product interacts with the baffle. In this embodiment, a valve means at the top of the separator may be provided for controlling the exit velocity of the propellant fluid with fines entrained therein. In addition, a wash air annulus may be included in the lower section of the separator to improve separation efficiency.

BRIEF DESCRIPTION OF THE DRAWING

The invention disclosed herein will be better understood and more completely appreciated with reference to the following drawing of which.

DESCRIPTION OF THE PREFERRED EMBODIMENTS

Figure 1:
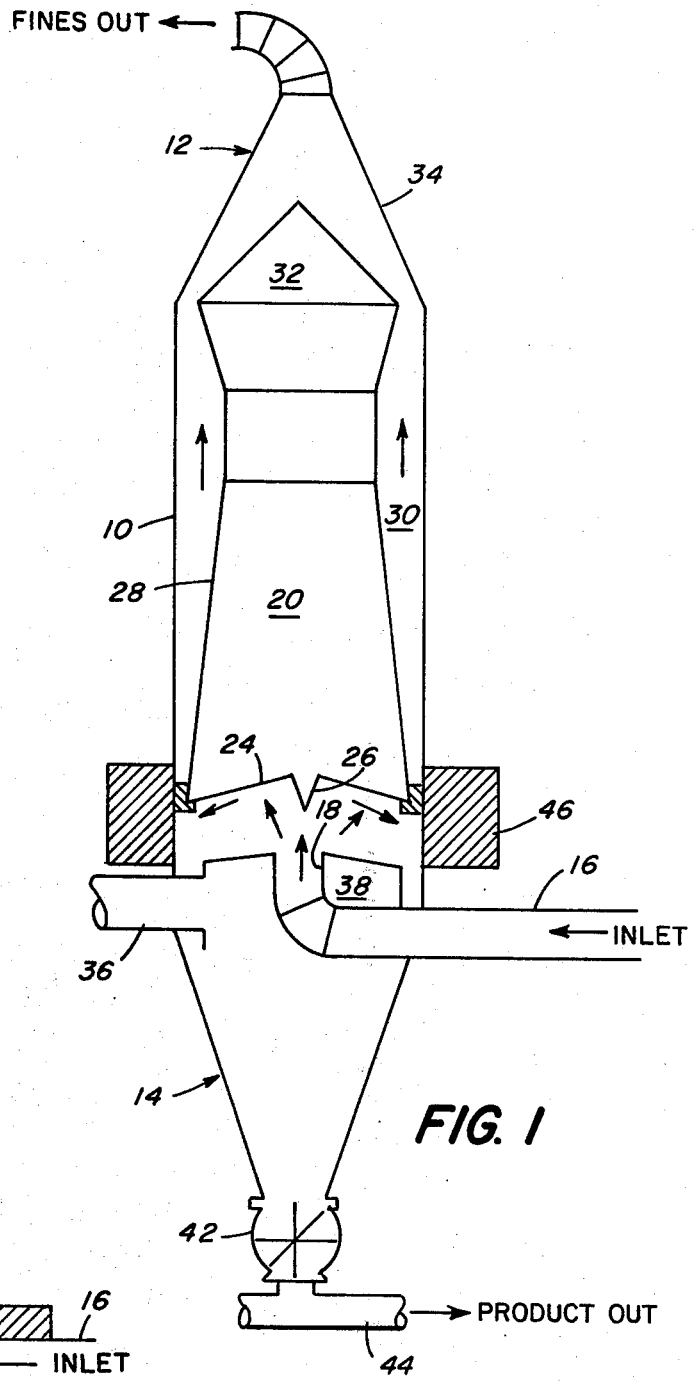
FIG. 1 is a cross-sectional view of one embodiment of the invention disclosed herein.

Referring first to FIG. 1, the separator disclosed herein comprises a generally cylindrical, vertically disposed housing 10, an upper fines outlet 12 and a lower product outlet portion 14. An inlet conduit 16 enters the housing 10 at a lower portion thereof but above the product outlet portion 14. The conduit 16 which terminates in an upwardly facing nozzle 18 is adapted for connection to a source of product pellets and fines entrained in a propellant fluid (e.g., pressurized air). The product supply system is entirely conventional and the details are not shown in FIG. 1.

Disposed within the cylindrical portion of the housing 10 and above the nozzle 18 is a baffle structure 20. The baffle structure 20 is supported within the housing 10 by any suitable means such as spaced apart clips 22. The baffle structure 20 includes a substantially concave lower surface 24 which faces the nozzle 18 and is located so as to intercept substantially all of the product and fines entrained in the pressurized fluid issuing upwardly from the nozzle 18. The surface 24 corresponds in function to the impact surface 26 in the drawing of the above-mentioned Avery patent. The lower surface 24 of the baffle structure 20 may also include a downwardly pointing conical section 26 which aids in redirecting the flow issuing from the nozzle 18. The baffle structure 20 also includes upwardly tapering lateral sides 28 which define with the housing 10 an annular conduit 30 whose cross-sectional area increases in the upward direction.

The top portion of the baffle structure 20 features a solid body 32. The body 32 in conjunction with a tapering portion 34 of the housing 10 forms a valving arrangement for adjusting the velocity of the propellant fluid and fines travelling through the separator. It is emphasized that the body 32 need not be attached to the baffle structure 20 as illustrated, but rather may be supported independently of the baffle structure 20 so that its vertical location may be adjusted to alter the cross-sectional area leading to the fines outlet 12. A suitable means for such adjustable support is analogous to that disclosed in the above-referenced Avery patent for supporting the solid body 46 depicted in that patent. A second inlet 36 is provided in the housing 10 between the baffle structure 20 and the product outlet section 14. This inlet 36 may be used to admit additional washing air which, in conjunction with an annulus 38, enhances the efficient separation of product from the fines.

Disposed around the inlet conduit 16 is a coil 40 made of conducting material. This coil when energized by a conventional source of direct or alternating current (not shown) generates a magnetic field within the conduit 16. A suitable coil along with its power conditioning apparatus is a linear kinetic cell manufactured by Ener-Tec, Inc. of Dayton, Ohio. Such a cell generates a substantially constant or at least nonreversing magnetic field within the conduit 16.

In operation, the mixture of product pellets and fines entrained in a propellant fluid travels within the conduit 16 through the magnetic field generated by the coil 40. While the precise physical mechanisms remain obscure, it is known that a magnetic field is capable of neutralizing static electric charges which pass through the field. Thus, when the coil 40 such as an Ener-Tec linear kinetic cell is operated in a voltage range of approximately 50 to 150 volts DC, the field so generated substantially neutralizes the static electric charges which may be present on the product pellets and fines entrained in the propellant fluid. As the product pellets and fines pass through the nozzle 18, therefore, they are substantially free of electric charges which otherwise would tend to bond the fines to the much larger pellet product. Thus, when the product pellets strike the lower surface 24 of the baffle structure 20, their momentum is absorbed, and they fall under the influence of gravity toward the outlet section 14. The rapid deceleration of the product upon interaction with the lower surface 24 of the baffle structure 20 tends effectively to separate the larger pellets from the fines or dust which, unlike the pellets, do not fall toward the outlet 14 but rather remained entrained in the propellant fluid flow. The fines are then transported into the annular conduit region 30 and travel thereafter past the solid body 32 to the fines outlet 12. Because the annular conduit 30 increases in cross-sectional area in the upward direction, the velocity of the propellant fluid decreases in that direction. If any of the product pellets were inadvertently transported into the region 30, they would settle and eventually drop into the outlet portion 14 because of the diminishing propellant velocity in the vertical direction in the annular conduit 30. The product pellets which fall into the outlet region 14 pass through a rotary valve 42 and thereafter pass into outlet conduit 44.

Figure 2:
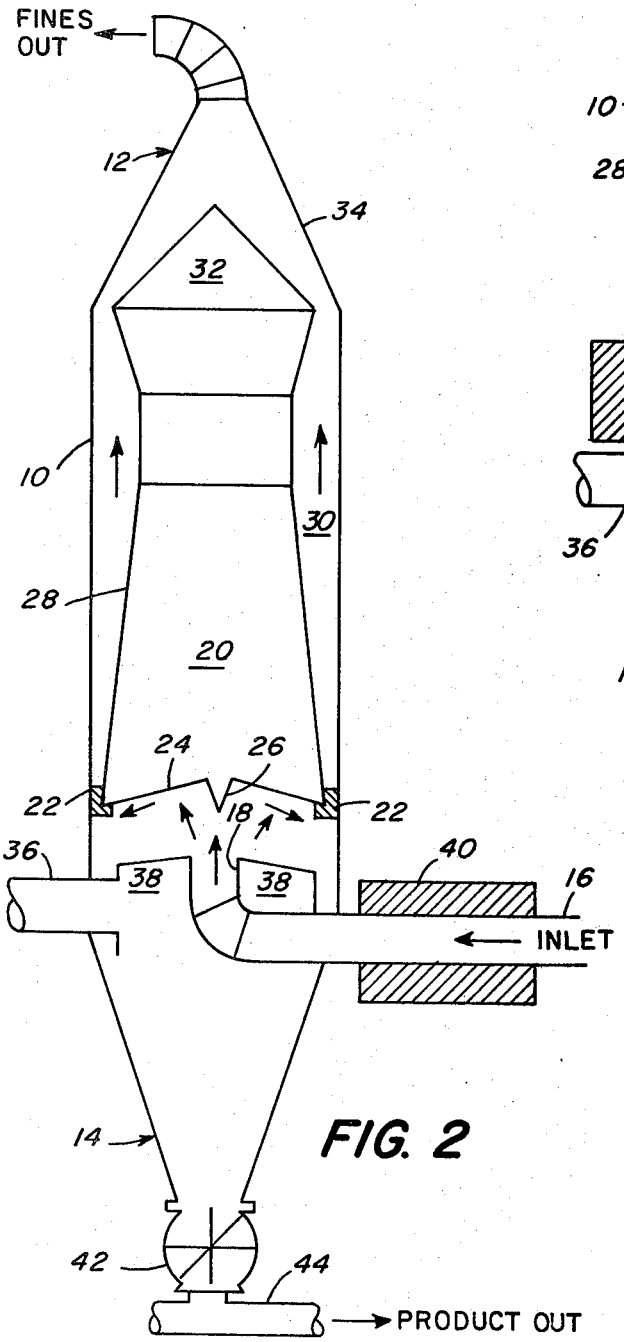
FIG. 2 is a cross-sectional view of another embodiment.

The embodiment of the invention illustrated in FIG. 2 is substantially analogous to the embodiment of FIG. 1. In this embodiment, however, a magnetic field generating coil 46 is disposed around the exterior portion of the housing 10 at a position between the nozzle 18 and the lower surface 24 of the baffle structure 20. As in the embodiment described in FIG. 1, a suitable magnetic field generating coil 46 is a linear kinetic cell of the type manufactured by Ener-Tec, Inc. This location for the coil 46 is suited for neutralizing substantially all of the static electricity on the product pellets and fines before the product pellets impact against the lower surface 24 of the baffle structure 20. Thus, as in the embodiment described with reference to FIG. 1, the fines readily separate from the larger product pellets since the electrostatic attraction therebetween has been substantially eliminated by the magnetic field produced by the coil 46.

Tests conducted both with the magnetic field in operation and without the magnetic field have shown surprising results. In particular, separation efficiencies have improved by between approximately 13 percent and 35 percent when the electrostatic charge neutralizing magnetic field is employed as compared with the separation capability without the magnetic field being present. This improved efficiency results from the substantial diminution of the attractive forces between the product pellets and the fines resulting from accumulated electrostatic charges.

In addition to the surprising increase in efficiency achieved by utilizing an electrostatic charge neutralizing magnetic field, the use of such a neutralizing magnetic field has other advantages as well. By substantially neutralizing the electrostatic charges, the risk that such charges might accidentally ignite residual hydrocarbons present in the housing 10 is greatly diminished. Although this invention has been described with particular emphasis on its utility for separating plastic product pellets from smaller dust particles, it should be understood that the static electricity neutralizing techniques disclosed herein have application in other areas as well. The neutralizing of static electric charges has application in a wide range of plastics handling activities employing pneumatic conveyance including blending, grinding, filtration as well as the loading of trucks and railroad cars.

SUMMARY OF THE ADVANTAGES OF THE INVENTION

The use of a magnetic field to neutralize static electric charges before the product pellets and fines impact upon a baffle in a separator like that disclosed in the above mentioned Avery reference substantially improves the separation capability of such a separator or elutriator. This improvement in efficiency occurs as a result of the diminution of electrostatic forces between the product pellets and fines which limited the separation capability of prior art devices. It is thus seen that the objects of this invention have been achieved in that there has been disclosed the use of a magnetic field to neutralize electrostatic charges in a separator of the Avery type to allow product pellets more effectively to be separated from the fines mixed therewith.

While this invention has been described with reference to particular embodiments it will be appreciated by those skilled in the art that additions, deletions, modifications and substitutions or other changes not specifically described may be made which will fall within the scope of the appended claims.

What is claimed is:

1. Apparatus for separating a pellet-like product from fines mixed therewith comprising:

a housing having a fines outlet and a product outlet disposed at a lower portion of said housing;

an inlet conduit extending into said housing for supplying said product and said fines entrained in a propellant fluid, said inlet conduit terminating in a nozzle;

an imperforate baffle disposed within said housing and having an impact surface spaced away from and facing said nozzle, said baffle located to intercept substantially all of said product issuing from said nozzle, said baffle sized to allow said propellant fluid to flow past said baffle to said fines outlet; and means located externally of said product and fines entrained in said propellant fluid for generating an electric charge neutralizing magnetic field, said field generating means located spatially with respect to said impact surface of said imperforate baffle so that said field completely envelops said product and fines entrained in said propellant fluid at a position before said product impinges on said baffle whereby separation of said product and said fines is improved.

2. The apparatus of claim 1 wherein said means for generating said field comprises an electrically conducting coil disposed around the outside of said inlet conduit.

3. The apparatus of claim 1 wherein said means for generating said field comprises an electrically conducting coil disposed around the outside of said housing at a location below the level of said impact surface of said baffle.

4. Apparatus for separating a pellet-like product from fines mixed therewith comprising:

a substantially symmetrical housing having a vertical axis of a symmetry, an upper fines outlet, a lower product outlet and an intermediate cylindrical portion;

an inlet conduit for supplying to the interior of said housing said product and said fines entrained in a propellant fluid, said inlet conduit extending into said cylindrical portion and terminating in an upwardly facing nozzle intermediate said fines outlet and said product outlet;

a baffle having an axis of symmetry coincident with the vertical axis of symmetry of said housing and disposed within said housing, said baffle including a substantially concave lower surface spaced apart from and facing said nozzle to allow vertical entry of said product and said fines entrained in said propellant fluid and located to intercept substantially all of said product issuing from said nozzle, said baffle further including upwardly tapering lateral sides to define, with said cylindrical portion of said housing, an annular flow conduit for said propellant fluid having a cross section which increases in area in the upward direction for expanding said propellant fluid to decrease its velocity; and means located externally of said product and fines entrained in said propellant fluid for generating an electric charge neutralizing magnetic field, said field generating means located spatially with respect to said baffle lower surface so that said field completely envelops said product and fines entrained in said propellant fluid at a position before said product impinges upon said lower surface of said baffle.

5. The apparatus of claim 4 wherein said means for generating said field comprises an electrically conducting coil disposed around the outside of said inlet conduit.

6. The apparatus of claim 4 wherein said means for generating said field comprises an electrically conducting coil disposed around the outside of said cylindrical portion of said housing at a location below said lower surface of said baffle.

7. The process for separating a pellet-like product from fines mixed therewith comprising the steps of:

providing a housing having a fines outlet and a product outlet disposed at a lower portion of said housing;

providing an inlet conduit extending into said housing, said inlet conduit terminating in a nozzle;

entraining said product and said fines in a propellant fluid and delivering said entrained product and fines to said inlet conduit for issuance from said nozzle;

providing an imperforate baffle secured within said housing, said baffle having an impact surface spaced away from and facing said nozzle, said baffle located to intercept substantially all of said product issuing from said nozzle, said baffle sized to allow said propellant fluid to flow past said baffle to said fines outlet; and generating externally of said product and fines entrained in said propellant fluid an electric charge neutralizing magnetic field at a location with respect to said baffle impact surface so that said field completely envelops said product and fines entrained in said propellant fluid at a position before said product impinges on said baffle whereby separation of said product and said fines is improved.

* * * * *